US006202045B1

(12) United States Patent
Ojala et al.

(10) Patent No.: US 6,202,045 B1
(45) Date of Patent: Mar. 13, 2001

(54) SPEECH CODING WITH VARIABLE MODEL ORDER LINEAR PREDICTION

(75) Inventors: Pasi Ojala, Lempäälä; Ari Lakaniemi; Vesa T. Ruoppila, both of Tampere, all of (FI)

(73) Assignee: Nokia Mobile Phones, Ltd., Espoo (FI)

( * ) Notice: Subject to any disclaimer, the term of this patent is extended or adjusted under 35 U.S.C. 154(b) by 0 days.

(21) Appl. No.: 09/163,845

(22) Filed: Sep. 30, 1998

(30) Foreign Application Priority Data

Oct. 2, 1997 (FI) ..... 973873

(51) Int. Cl.[7] ..... G10L 19/04
(52) U.S. Cl. ..... 704/203; 704/219
(58) Field of Search ..... 704/219, 220, 704/203, 201, 205

(56) References Cited

U.S. PATENT DOCUMENTS

| | | | | |
|---|---|---|---|---|
| 4,890,327 | * | 12/1989 | Bertrand et al. | 704/219 |
| 4,969,192 | | 11/1990 | Chen et al. . | |
| 5,243,686 | * | 9/1993 | Tokuda et al. | 704/200 |
| 5,444,816 | | 8/1995 | Adoul et al. . | |
| 5,483,668 | | 1/1996 | Malkamaki et al. . | |
| 5,579,433 | | 11/1996 | Jarvinen . | |
| 5,732,188 | * | 3/1998 | Moriya et al. | 704/219 |
| 5,742,733 | | 4/1998 | Jarvinen . | |
| 5,761,635 | | 6/1998 | Jarvinen . | |
| 5,787,390 | * | 7/1998 | Quinquis et al. | 704/219 |
| 5,890,110 | * | 3/1999 | Gersho et al | 704/222 |
| 5,933,803 | * | 8/1999 | Ojala | 704/223 |

OTHER PUBLICATIONS

Ojala et al., "Variable model order LPC quantization," Proceedings of the 1998 IEEE International Conference on Acoustics, Speech and Signal Processing, vol. 1, pp. 49–52, May 1998.*

GSM 06.60, ETS, Second Editon, pp. 1–52, Jun. 1998.

"Efficient Vector Quantisation of LPC Parameters at 24 Bits/Frame" Kuldip et al., IEEE Transactions Speech and Audio Processing, vol. 1, No. 1, Jan. 1993.

"Digital Speech (Coding for Low Bit Rate Communcation System)", Wiley & Sons, N.Y. 1994, pp. 42–53.

"A Comparative Study of AR Order Selection Methods", Dickie et al., Signal Processing 40, pp. 239–255, 1994.

* cited by examiner

*Primary Examiner*—David R. Hudspeth
*Assistant Examiner*—Martin Lerner
(74) *Attorney, Agent, or Firm*—Perman & Green, LLP

(57) ABSTRACT

A method of coding a sampled speech signal in which the speech signal is divided into sequential frames. For each current frame, a first set of linear prediction coding (LPC) coefficients are generated, where the number of LPC coefficients depends upon the characteristics of the current frame. If the number of LPC coefficients in the first set of the current frame differs from the number in the first set of the preceding frame, then a second expanded or contracted set of LPC coefficients is generated from the first set of LPC coefficients for the preceding frame. This second set contains the same number of LPC coefficients as are present in said first set of the current frame. Respective sets of line spectral frequency (LSP) coefficients are generated for the first set of LPC coefficients of the current frame and the second set of LPC coefficients of the preceding frame. The sets of LSP coefficients are then combined to provide an encoded residual signal.

21 Claims, 7 Drawing Sheets

SPEECH CODING WITH VARIABLE MODEL ORDER LINEAR PREDICTION

FIELD OF THE INVENTION

The present invention relates to speech coding and more particularly to speech coding using linear predictive coding (LPC). The invention is applicable in particular, though not necessarily, to code excited linear prediction (CELP) speech coders.

BACKGROUND OF THE INVENTION

A fundamental issue in the wireless transmission of digitised speech signals is the minimisation of the bit-rate required to transmit an individual speech signal. By minimising the bit-rate, the number of communications which can be carried by a transmission channel, for a given channel bandwidth, is increased. All of the recognised standards for digital cellular telephony therefore specify some kind of speech codec to compress speech data to a greater or lesser extent. More particularly, these speech codecs rely upon the removal of redundant information present in the speech signal being coded.

In Europe, the accepted standard for digital cellular telephony is known under the acronym GSM (Global System for Mobile communications). GSM includes the specification of a CELP speech encoder (Technical Specification GSM 06.60). A very general illustration of the structure of a CELP encoder is shown in FIG. 1. A sampled speech signal is divided into 20 ms frames, defined by a vector x(j), of 160 sample points, j=0 to 159. The frames are encoded in turn by first applying them to a linear predictive coder (LPC) 1 which generates for each frame x(j) a set of LPC coefficients a(i), i=0 to n, which are representative of the short term redundancy in the frame. In GSM, n is predefined as ten.

The output from the LPC comprises this set of LPC coefficients a(i) and a residual signal r(j) produced by removing the short term redundancy from the input speech frame using a LPC analysis filter. The residual signal is then provided to a long term predictor (LTP) 2 which generates a set of LTP parameters b which are representative of the long term redundancy in the residual signal. In practice, long term prediction is a two stage process, involving a first open loop estimate of the LTP coefficients and a second closed loop refinement of the estimated parameters.

An excitation codebook 3 is provided which contains a large number of excitation codes. For each frame, each of these codes is provided in turn, via a scaling unit 4, to a LTP synthesis filter 5. This filter 5 receives the LTP parameters from the LTP 2 and introduces into the code the long term redundancy predicted by the LTP parameters. The resulting frame is then provided to a LPC synthesis filter 6 which receives the LPC coefficients and introduces the predicted short term redundancy into the code. The predicted frame $x_{pred}(j)$ is compared with the actual frame x(j) at a comparator 7, to generate an error signal e(j) for the frame. The code c(j) which produces the smallest error signal, after processing by a weighting filter 8, is selected by a codebook search unit 9. A vector u(j) identifying the selected code is transmitted over the transmission channel 10 to the receiver. The LPC coefficients and the LTP parameters are also transmitted but, prior to transmission, they themselves are encoded to minimise still further the transmission bit-rate.

The LPC analysis filter (which removes redundancy from the input signal to provide the residual signal r(j)) is shown schematically in FIG. 2. The input code ĉ(j) (as modified by the LTP synthesis filter) is combined with delayed versions of itself ĉ(j−i), the LPC coefficients a(i) providing the gain factors for respective delayed versions and with a(O)=1. The filter can be defined by the expression:

$$A(z)=1+a(l)z^{-1}+\ldots+a(n)z^{-n}$$

where z represents a delay of one sample.

The LPC coefficients are converted into a corresponding number of line spectral pair (LSP) coefficients, which are the roots of the two polynomials given by:

$$P(z)=A(z)+z^{-(n+1)}A(z^{-1})$$

and $$Q(z)=A(z)-z^{-(n+1)}A(z^{-1})$$

Typically, the LSP coefficients of the current frame are quantised using moving average (MA) predictive quantisation. This involves using a predetermined average set of LSP coefficients and subtracting this average set from the current frame LSP coefficients. The LSP coefficients of the preceding frame are multiplied by respective (previously determined) prediction factors to provide a set of predicted LSP coefficients. A set of residual LSP coefficients is then obtained by subtracting the mean removed LSP coefficients from the predicted LSP coefficients. The LSP coefficients tend to vary little from frame to frame, as compared to the LPC coefficients, and the resulting set of residual coefficients lend themselves well to subsequent quantisation ('Efficient Vector Quantisation of LPC Parameters at 24 Bits/Frame', Kuldip K. P. and Bishnu S. A., IEEE Trans. Speech and Audio Processing, Vol 1, No 1, January 1993).

The number of LPC coefficients (and consequently the number of LSP coefficients), determines the accuracy of the LPC. However, for any given frame, there exists an optimal number of LPC coefficients which is a trade off between encoding accuracy and compression ratio. As already noted, in the current GSM standard, the order of the LPC is fixed at n=10, a number which is high enough to encode all expected speech frames with sufficient accuracy. Whilst this simplifies the LPC, reducing computational requirements, it does result in the 'over-coding' of many frames which could be coded with fewer LPC coefficients than are specified by this fixed rate.

Variable rate LPC's have been proposed, where the number of LPC coefficients varies from frame to frame, being optimised individually for each frame. Variable rate LPCs are ideally suited to CDMA networks, the proposed GSM phase 2 standard, and the future third generation standard (UTMS). These networks use, or propose the use of, 'packet switched' transmission to transfer data in packets (or bursts). This compares to the existing GSM standard which uses 'circuit switched' transmission where a sequence of fixed length time frames are reserved on a given channel for the duration of a telephone call.

Despite the advantages, a number of technical problems must be overcome before a variable rate LPC can be satisfactorily implemented. In particular, and as has been recognised by the inventors of the invention to be described below, a variable rate LPC is incompatible with the LSP coefficient quantisation scheme described above. That is to say that it is not possible to directly generate a predictive, quantised LSP coefficient signal when the number of LSP coefficients is varying from frame to frame. Furthermore, it is not possible to interpolate LPC (or LSP) coefficients between frames in order to smooth the transition between frame boundaries.

SUMMARY OF THE INVENTION

According to a first aspect of the present invention there is provided a method of coding a sampled speech signal, the method comprising dividing the speech signal into sequential frames and, for each current frame:

generating a first set of linear prediction coding (LPC) coefficients which correspond to the coefficients of a linear filter and which are representative of short term redundancy in the current frame;

if the number of LPC coefficients in the first set of the current frame differs from the number in the first set of the preceding frame, then generating a second expanded or contracted set of LPC coefficients from the first set of LPC coefficients generated for the preceding frame, the second set containing a number of LPC coefficients equal to the number of LPC coefficients in said first set of the current frame; and encoding the current frame using the first set of LPC coefficients of the current frame and the second set of LPC coefficients of the preceding frame.

The present invention is applicable in particular to variable bit-rate wireless telephone networks in which data is transmitted in bursts, e.g. packet switched transmission systems. The invention is also applicable, for example, to fixed bit-rate networks in which a fixed number of bits are dynamically allocated between various parameters.

Sampled speech signals suitable for encoding by the present invention include 'raw' sampled speech signals and processed sampled speech signals. The latter class of signals include speech signals which have been filtered, amplified, etc. The sequential frames into which the sampled speech signal is divided, may be contiguous or overlapping.

The present invention is applicable in particular, though not necessarily, to the real time processing of a sampled speech signal where a current frame is encoded on the basis of the immediately preceding frame.

Preferably, the step of generating the first set of LPCs comprises deriving the autocorrelation function for each frame and solving the equation:

$$a_{opt} = \underline{\underline{R}}_{XX}^{-1} \cdot R_{XX}$$

where $\underline{a}_{opt}$ are the set of LPCs which minimise the squared error between the current frame x(k) and a frame x(k) predicted using these LPCs. $\underline{\underline{R}}_{XX}$ and $\underline{R}_{XX}$ are the autocorrelation matrix and autocorrelation vector respectively of x(k). In order to make the solution of the above equation tractable, one of a number of algorithms which provide an approximate solution may be used. Preferably, these algorithms have the property that they use a recursive process to approximate the LPCs from the autocorrelation function.

A particularly preferred algorithm is the Levinson-Durbin algorithm in which reflection coefficients are generated as an intermediate product. In embodiments using this algorithm, the second expanded or contracted set of LPC coefficients is generated by either adding zero value reflection coefficients, or removing already calculated reflection coefficients, and using the amended set of reflection coefficients to recompute the LPCs.

Preferably, said step of encoding comprises transforming the first set of LPC coefficients of the current frame, and the second set of LPC coefficients of the preceding frame, into respective sets of transformed coefficients. Preferably, said transformed coefficients are line spectral frequency (LSP) coefficients and the transformation is done in a known manner. Alternatively, the transformed coefficients may be inverse sine coefficients, immittance spectral pairs (ISP), or log-area ratios.

Preferably, the step of encoding comprises encoding the first set of LPC coefficients of the current frame relative to the second set of LPC coefficients of the preceding frame to provide an encoded residual signal. Said encoded residual signal may be obtained by evaluating the differences between said two sets of transformed coefficients. The differences may then be encoded, for example, by vector quantisation. Prior to evaluating said differences, one or both of the sets of transformed coefficients may be modified, e.g. by subtracting therefrom a set of averaged or mean transformed coefficient values.

According to a second aspect of the present invention there is provided a method of decoding a sampled speech signal which contains encoded linear prediction coding (LPC) coefficients for each frame of the signal, the method comprising, for each current frame:

decoding the encoded signal to determine the number of LPC coefficients encoded for the current frame;

where the number of LPC coefficients in a set of LPC coefficients obtained for the preceding frame differs from the number of LPC coefficients encoded for the current frame, expanding or contracting said set of LPC coefficients of the preceding frame to provide a second set of LPC coefficients; and combining said second set of LPC coefficients of the preceding frame with LPC coefficient data for the current frame to provide at least one set of LPC coefficients for the current frame.

Where the encoded signal contains a set of encoded residual signal, the encoded signal is decoded to recover the residual signals. The residual signals are then combined with the second set of LPC coefficients of the preceding frame to provide LPC coefficients for the current frame.

The set of LPC coefficients obtained for the current frame, and the second set obtained for the preceding frame, may be combined to provide sets of LPC coefficients for sub-frames of each frame. Preferably, the sets of coefficients are combined by interpolation. Interpolation may alternatively be carried out using LSP coefficients or reflection coefficients, with the combined LPC coefficients being subsequently derived from these interpolated coefficients.

According to a third aspect of the present invention there is provided computer means arranged and programmed to carry out the method of the above first and/or second aspect of the present invention. In one embodiment, the computer means is provided in a mobile communications device such as a mobile telephone. In another embodiment, the computer means forms part of the infrastructure of a cellular telephone network. For example, the computer means may be provided in the base station(s) of such an infrastructure.

BRIEF DESCRIPTION OF THE DRAWINGS

For a better understanding of the present invention and in order to show how the same may be carried into effect reference will now be made, by way of example, to the accompanying drawings, in which.

DETAILED DESCRIPTION

Figure 1:
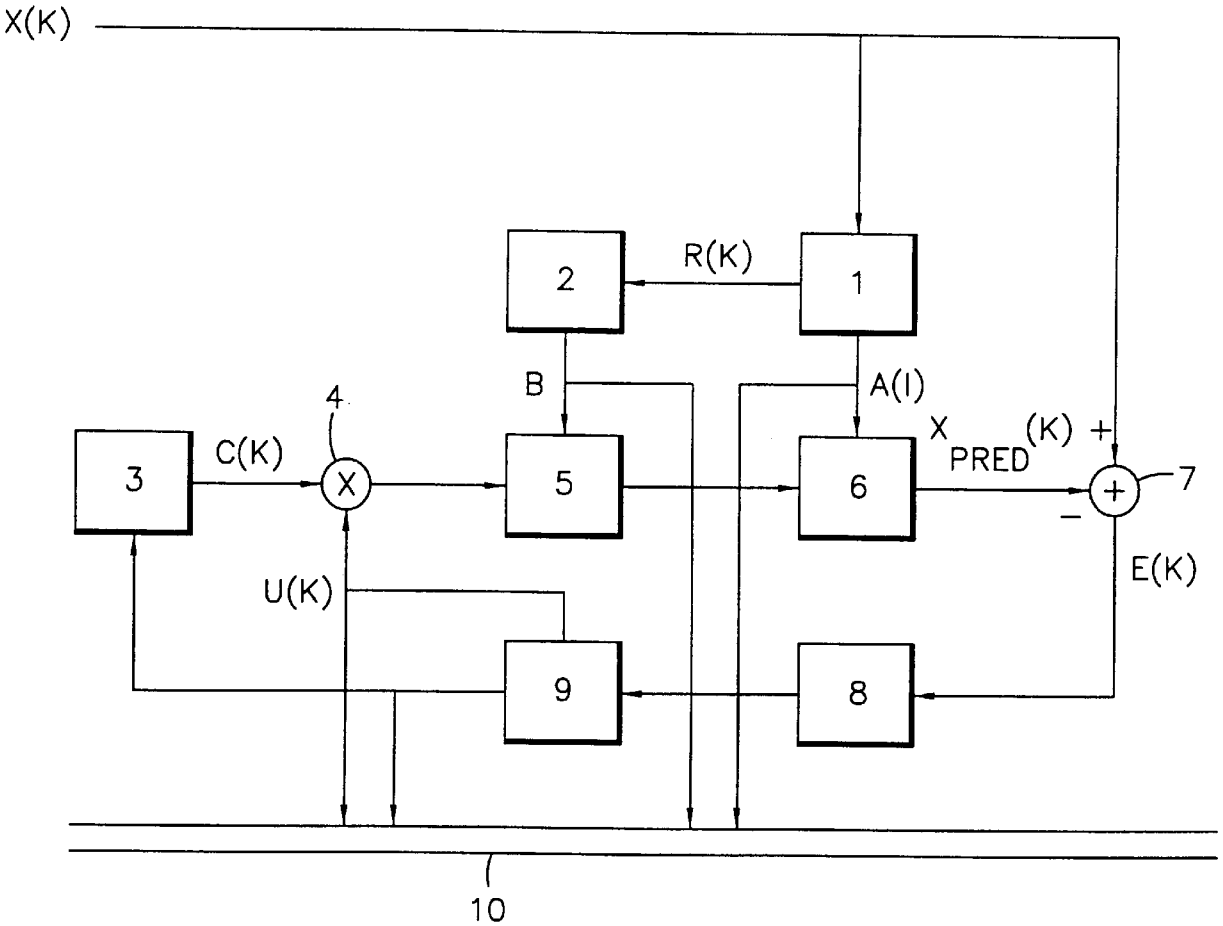
FIG. 1 (PRIOR ART)
FIG. 1 shows a block diagram of a typical CELP speech encoder.

The general architecture of a CELP speech encoder has been described above with reference to FIG. 1. In the linear predictive coder (LPC), each current frame x(j) is first expanded to 240 samples by adding the last 40 samples from the previous frame and the first 40 samples from the next frame to give an expanded current frame x(k), where k=0 to 239. The linear LPC provides a set of LPC coefficients a(i), i=0 to n, which enable a predicted frame $\hat{x}(k)$ to be generated from the current frame x(k), i.e:

$$\hat{x}(k) = \sum_{i=1}^{n} a(i) \cdot x(k-i). \tag{1}$$

The difference between the predicted frame and the current frame is the prediction error d(k):

$$d(k)=x(k)-\hat{x}(k) \tag{2}$$

The optimum set of prediction coefficients can be determined by differentiating the expectation of the squared prediction error (i.e. the variance) $E(d^2)$ with respect to $a(\lambda)$, where $\lambda$ is a delay, and solving for a(i) when the resulting differential equation is equated to zero, i.e:

$$\begin{aligned} \frac{\partial E(d^2)}{\partial a(\lambda)} &= E\{-2 \cdot d(k) \cdot x(k-\lambda)\} \\ &= -2r_\lambda + 2 \cdot \sum_{i=1}^{n} a(i) \cdot r_{1-i} = 0, \end{aligned} \tag{3}$$

where r are the coefficients of the autocorrelation function. This equation can be written in matrix form as:

$$\begin{bmatrix} r_1 \\ r_2 \\ r_3 \\ r_4 \\ \vdots \\ r_n \end{bmatrix} = \begin{bmatrix} r_0 & r_1 & r_2 & r_3 & \cdots & r_{n-1} \\ r_1 & r_0 & r_1 & r_2 & \cdots & r_{n-2} \\ r_2 & r_1 & r_0 & r_1 & \cdots & r_{n-3} \\ r_3 & r_2 & r_1 & r_0 & \cdots & r_{n-4} \\ \vdots & \vdots & \vdots & \vdots & & \vdots \\ r_{n-1} & r_{n-2} & r_{n-3} & r_{n-4} & \cdots & r_0 \end{bmatrix} \begin{bmatrix} a(1) \\ a(2) \\ a(3) \\ a(4) \\ \vdots \\ a(n) \end{bmatrix}. \tag{4}$$

Alternatively, the equation can be expressed as:

$$a_{opt}=\underline{\underline{R}}^{-1} \cdot \underline{R} \tag{5}$$

where R is the correlation matrix, $\underline{R}$ is the correlation vector, and $\underline{\underline{a}}_{opt}$ is the optimised coefficient vector.

As the correlation matrix is of the symmetric Toeplitz type, the matrix equation can be solved using the well known Levinson-Durbin approach (see Kondoz A. M., 'Digital Speech (Coding for Low Bit Rate Communication Systems)' John Wiley & Sons, New York. 1994). With $\alpha(i)=-a(i)$, and considering the example where n=3, equation (4) can be rewritten as:

$$\begin{bmatrix} r_1 & r_0 & r_1 & r_2 \\ r_2 & r_1 & r_0 & r_1 \\ r_3 & r_2 & r_1 & r_0 \end{bmatrix} \cdot \begin{bmatrix} 1 \\ \alpha(1) \\ \alpha(2) \\ \alpha(3) \end{bmatrix} = \begin{bmatrix} 0 \\ 0 \\ 0 \end{bmatrix} \tag{6}$$

An auxiliary equation for the prediction error d can be written as:

$$\begin{aligned} d &= r_0 - \sum_{i=1}^{n} a(i) \cdot r_i \\ &= r_0 + \sum_{i=1}^{n} \alpha(i) \cdot r_i \end{aligned} \tag{7}$$

and can be appended to equation (6) to give:

$$\begin{bmatrix} r_0 & r_1 & r_2 & r_3 \\ r_1 & r_0 & r_1 & r_2 \\ r_2 & r_1 & r_0 & r_1 \\ r_3 & r_2 & r_1 & r_0 \end{bmatrix} \cdot \begin{bmatrix} 1 \\ \alpha(1) \\ \alpha(2) \\ \alpha(3) \end{bmatrix} = \begin{bmatrix} d \\ 0 \\ 0 \\ 0 \end{bmatrix} \tag{8}$$

Initially, the n+1 autocorrelation functions are calculated. Then the following recursive algorithm is used to compute the LPC coefficients from equation (8):

BEGIN (1) define constant p=0

(2) predicted output $\hat{x}(k)=x(k)$, and define $\alpha_0(\mathbf{0})=1$ (3) prediction error (first iteration) $d_0=r_0$ (4) set p=1 and begin iteration (5) reflection coefficient $$k_p = -\frac{1}{d_{p-1}} \sum_{i=0}^{p-1} \alpha_{p-1}(i) \cdot r_{p-i}$$

(6) $\alpha_p(p)=k_p$ (7) if p=1 go to (10)

(8) For i=1 to p−1

(9) $\alpha_p(i)=\alpha_{p-1}(i)+k_p \cdot \alpha_{p-1}(p-i)$

(10) update prediction error $d_p=d_{p-1} \cdot (1-k_p^2)$

(11) p=p+1

(12) if $p \leqq n$ go to (5)

(13) LPC coefficients $a(i)=-\alpha(i)$; i=1,2. . . . .n

(14) $a(\mathbf{0})=\alpha(\mathbf{0})$

In the first iteration, a first estimate of $\alpha(\mathbf{1})=\alpha_1(\mathbf{1})$ is made. In the second iteration, an estimate of $\alpha(\mathbf{2})=\alpha_2(\mathbf{2})$ is made and the estimate of $\alpha(\mathbf{1})=\alpha_2(\mathbf{1})$ updated. Similarly, the second iteration provides an estimate $\alpha_3(\mathbf{3})$ and updated estimates $\alpha_3(\mathbf{1})$ and $\alpha_3(\mathbf{2})$. It will be appreciated that the iteration may be stopped at an intermediate level if fewer than n+1 LPC coefficients are desired.

Figure 2:
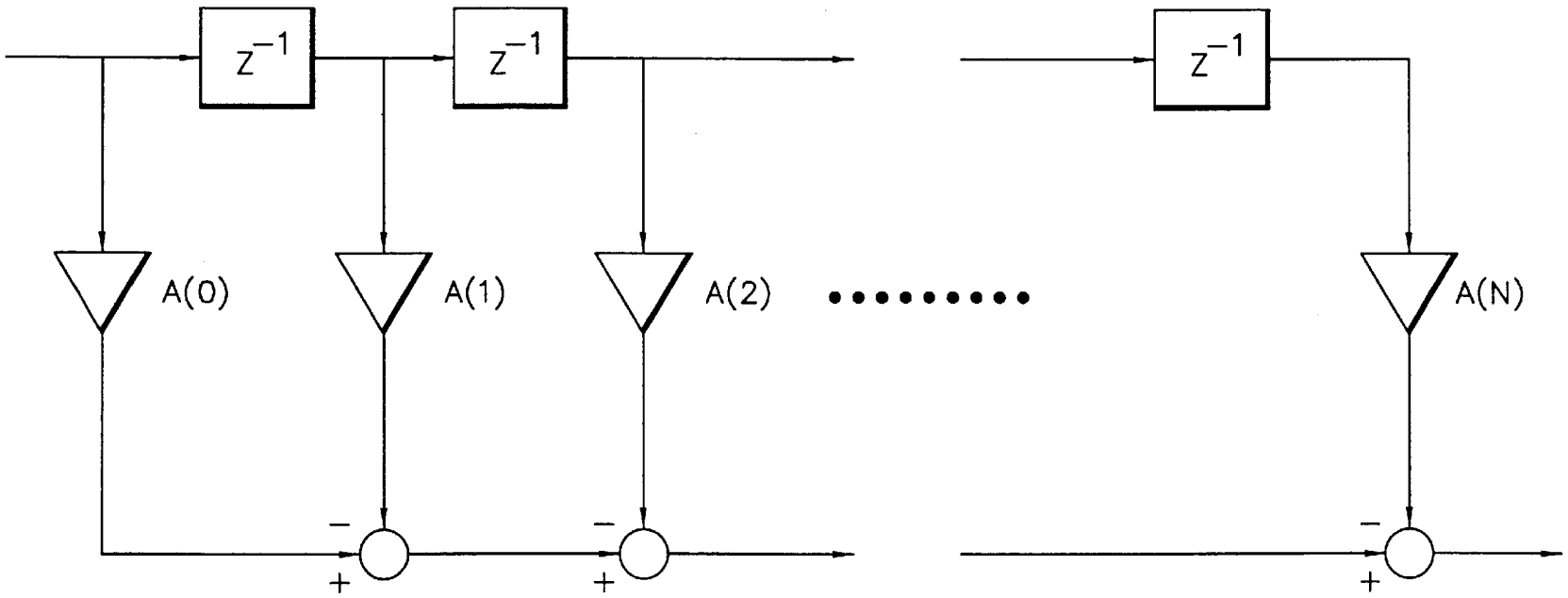
FIG. 2 (PRIOR ART)
FIG. 2 illustrates an LPC analysis filter.
Figure 3:
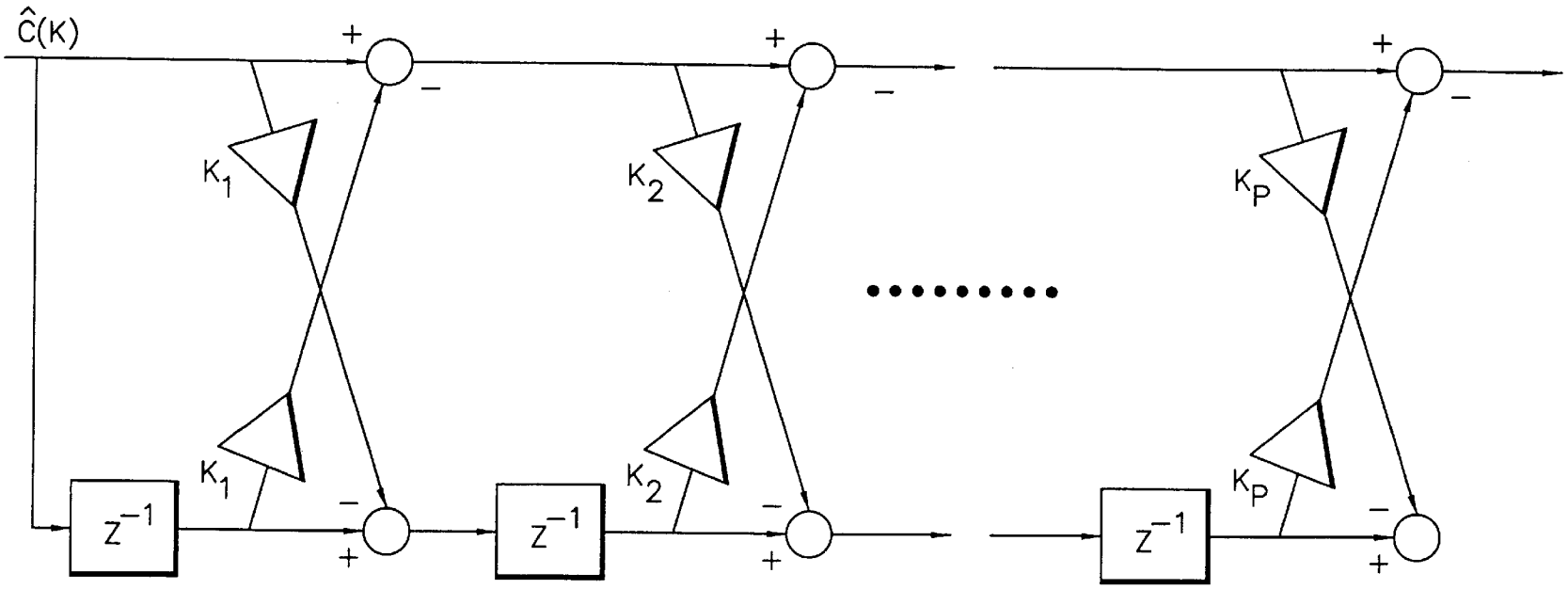
FIG. 3 illustrates a lattice structure analysis filter equivalent to the LPC analysis filter of FIG. 2.

The above iterative solution provides a set of reflection coefficients $k_p$ which are the gains of the analysis filter of FIG. 2, when that filter is implemented in a lattice structure as illustrated in FIG. 3. Also provided at each level of iteration is the prediction error $d_p$. This error is seen to decrease as the level, and the number of LPC coefficients, increases and is used to determine the number of LPC coefficients encoded for a given frame. Typically, n has a maximum value of 10, but the iteration is stopped when the decrease in prediction error achieved by increasing the model order becomes so small that it is offset by the increase in the number of LPC coefficients required. Several model order selection criteria are known, including the Akaike Information Criterion (AIC) and Rissanen's Minimum Description Length (MDL), see "A Comparative Study Of AR Order Selection Methods", Dickie, J. R. & Nandi, A. K., Signal Processing 40, 1994, pp 239–255.

As has already been described, the resulting (variable rate) LPC coefficients are converted into LSP coefficients to provide for more efficient quantisation. Consider the example where a current sampled speech frame generates six LPC coefficients, and hence also five LSP coefficients, whilst the previous frame generated only three LSP coefficients. It is not possible to directly generate a set of LSP residuals for quantisation due to this mismatch. This problem is overcome by reverting to the three reflection coefficients generated for the previous frame $k_1,k_2,k_3$, and defining a further two reflection coefficient $k_4$, $k_5=0$. A new set of six LPC coefficients is generated for the preceding frame by carrying out steps (6) to (13) of the iteration process described above (with step (12) providing a jump to step (6)) for the new set of reflection coefficients. Initially, n=5, p=1, $\alpha_0(\mathbf{0})=1$, and $d_0=r_0$. The new set of (six) LPC coefficients is converted to a corresponding set of LSP coefficients. A set of encoded residuals is then calculated, as outlined above, prior to transmission.

In cases where the number of LPC coefficients produced for the previous frame exceeds the number produced for the current frame, it is necessary to reduce the former number before a set of LSP residuals can be calculated. This is done by removing an appropriate number of the higher order reflection coefficients generated for the preceding frame (e.g. if there are two extra LPC coefficients in the preceding frame, the two highest order reflection coefficients are removed) and recomputing the LPC coefficients. It is noted that, in contrast to the expansion process described in the preceding paragraph, this contraction results in some loss of the fine structure of the original speech signal. However, this disadvantage is negligible when compared to the advantages achieved by the overall LPC coding process.

Figure 4:
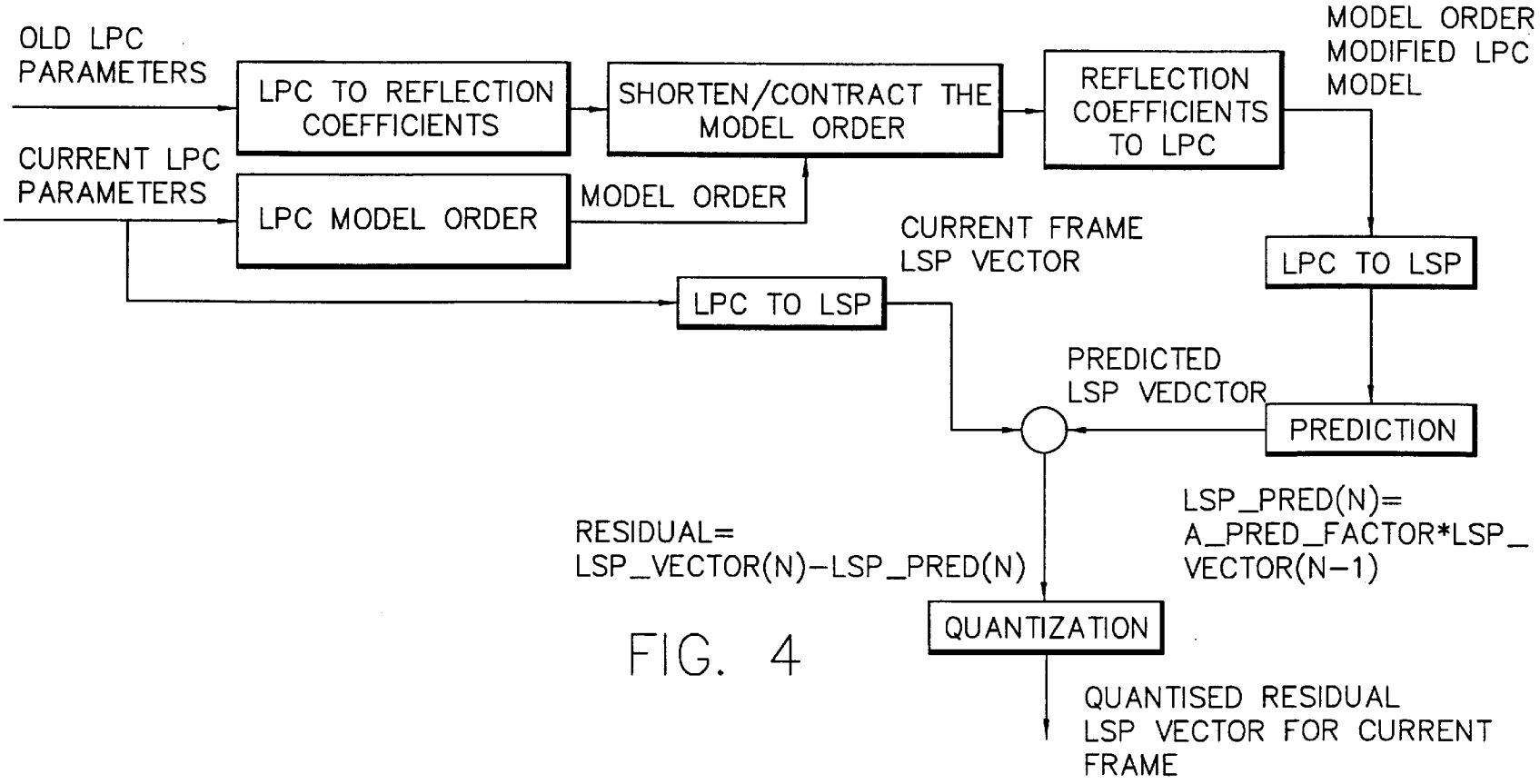
FIG. 4 is a block diagram illustrating an embodiment of the invented method for quantising variable order LPC coefficients.

FIG. 4 is a block diagram of a portion of a LPC suitable for quantising variable rate LPC coefficients using the process described above.

The above detailed description is concerned with a CELP speech encoder. It will be appreciated that an analogous process must be carried out in the decoder which receives an encoded signal. More particularly, when encoded data corresponding to a single (current) frame is received, and the number of residual coefficients for that frame differs from that received for the preceding frame, the LPC coefficients determined at the decoder for the previous frame are processed to provide a set of reflection coefficients as follows:

(1) $\alpha_p(i)=-a(i), 1\leqq i\leqq p$ (2) for i=p to 1

(3) $k(i)=-\alpha(i)$ (4) for j=1 to i−1

(5) $\alpha_{i-1}(j)=(\alpha_1(j)+k(i)\alpha_i(i-j))/(1-k(i)^2)$ (6) j=j+1

(6) i=i−1

This resulting set of reflection coefficients is expanded, by adding extra zero value coefficients, or contracted, by removing one or more existing coefficients. The modified set is then converted back into a set of LPC coefficients, which is in turn converted to a set of LSP coefficients. The LSP coefficients for the current frame are determined by carrying out the reverse of the predictive quantisation process described above.

It will be appreciated by a person of skill in the art that modifications may be made to the above described embodiments without departing from the scope of the present invention. For example, at the decoder, each frame may be divided into four (or any other suitable number) subframes, with a set of LSP coefficients being determined for each subframe by interpolating the LSP coefficients obtained for the current frame and the expanded or contracted set of LSP coefficients determined for the preceding frame, i.e.:

$$\hat{q}_1(n)=0.25\hat{q}(n)+0.75\hat{q}(n-1)$$

$$\hat{q}_2(n)=0.5\hat{q}(n)+0.5\hat{q}(n-1)$$

$$\hat{q}_3(n)=0.75\hat{q}(n)+0.25\hat{q}(n-1)$$

$$\hat{q}_4(n)=\hat{q}(n)$$

where $\hat{q}_i(n)$ contains the LSP parameters in the i;th subframe of the current frame, $\hat{q}(n)$ is the LSP coefficient vector of the current frame, and $\hat{q}(n-1)$ is the expanded or contracted LSP coefficient vector of the preceding frame. It will be appreciated that expansion or contraction of the preceding LSP vector is required even where the LSP coefficients are not encoded as residual coefficients. Typically, interpolation is also carried out in the decoder to ensure that the chosen codebook vector approximates the true encoded error signal.

Furthermore, the accuracy can be further improved by converting the LPC model in each frame into more than one, preferable every available model order using the model order conversion described earlier. Using the converted models, the predictors of each model order can be driven in parallel, and the predictor corresponding to the model order of the current frame can be used. This concept is described with the embodiment illustrated in FIG. 5.

Figure 5:
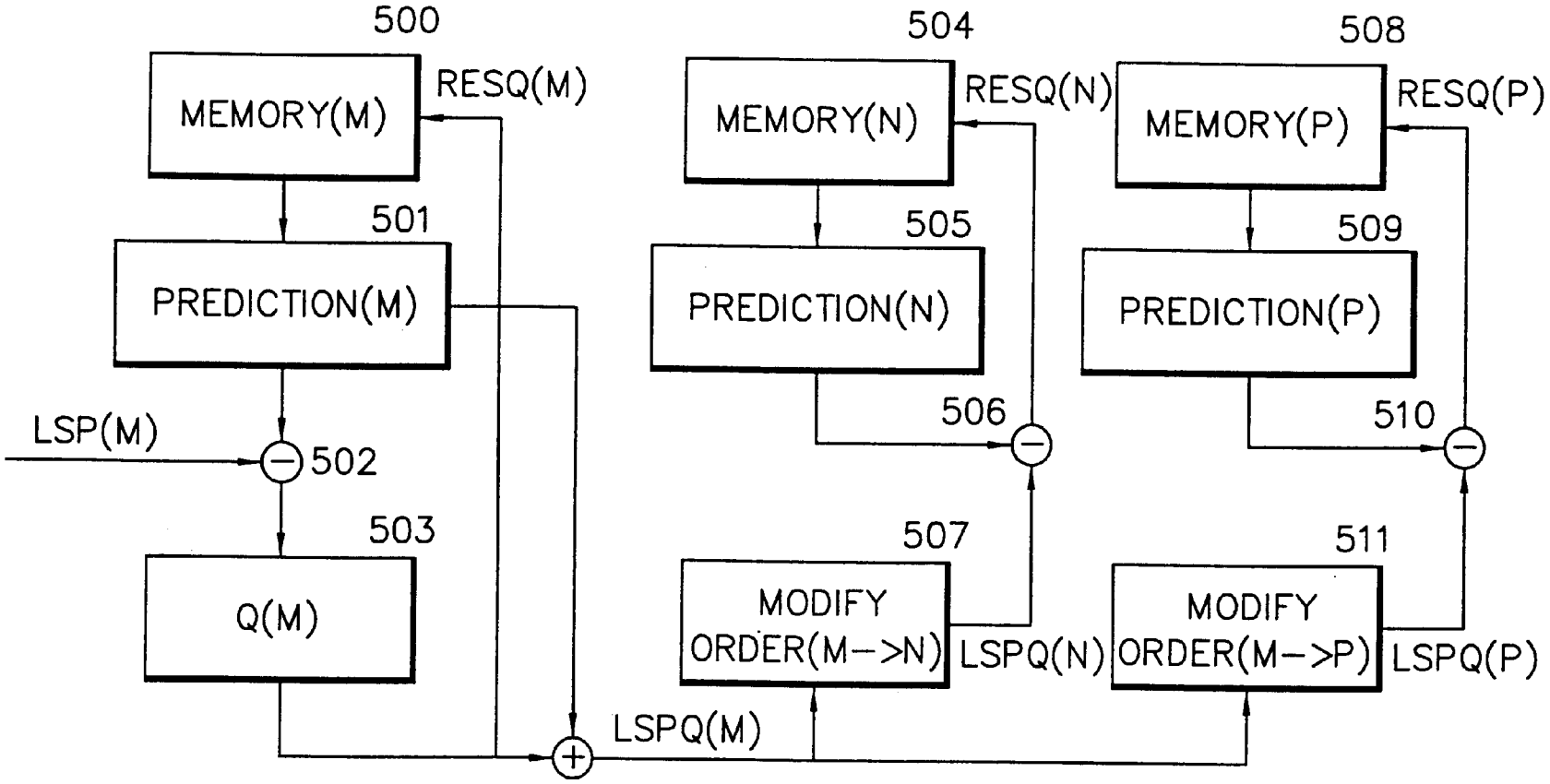
FIG. 5 is a block diagram illustrating another embodiment of the invented encoding method.

In FIG. 5, for residual vectors, memory blocks 500, 504, 508 for each different model order M, N, P respectively are shown. According to the model order of the current LSP(M) vector, the residual vector in the memory 500 corresponding to model order M is applied to predict 501 the current vector. The prediction residual is derived by a subtractor 502 using said predicted LSP vector and current frame vector, and quantized in a quantization block 503 in a known manner. However, the quantized LSP vector is utilised to update the predictor of this model order, and also predictors reserved for other model orders. In this embodiment the predictors for all further available model orders N, P are updated in blocks 507, 511. The predicted vectors corresponding model orders N, P are calculated already described in blocks 505 and 509, and used with the determined LSP vectors LSPQ(N), LSPQ (P) to calculate the prediction residuals in blocks 506 and 510. The determined residuals RESQ(N) and RESQ(P) are then stored in the predictor memories 502, 508. Thus, for different model orders of the current frame LSP (and naturally LPC) vector, a predictor with corresponding model order is available.

Figure 6:
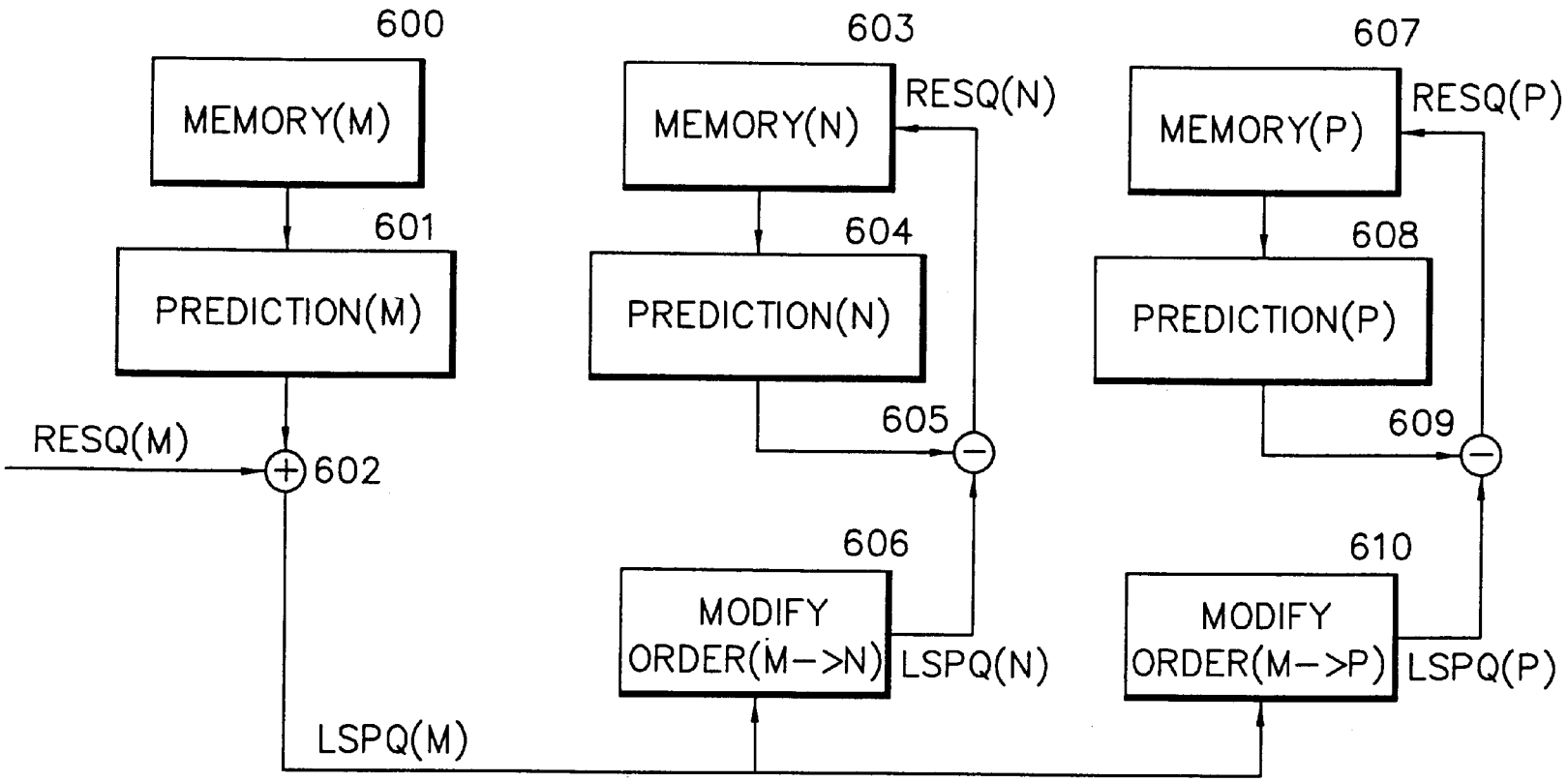
FIG. 6 is a block diagram illustrating other embodiment of the invented decoding method.

The method of decoding corresponding to the embodiment of FIG. 5 is illustrated in FIG. 6. The quantised residual RESQ(M) of the order M and the prediction vector of the same order M from memory 600 and prediction block 601 are used to calculate the current LSP vector in block 602. The input residual vector RESQ(M) is stored in the memory 600 corresponding to the model order M, and the decoded LSP vector LSPQ(M) is modified in the described way in blocks 606 and 610 to produce decoded LSP vectors LSP of different model orders. In each prediction block 604, 608 a corresponding model order prediction vector is determined, and the prediction residuals RESQ(N) and RESQ(P) are stored in the corresponding memories 603, 607. It will be appreciated that the encoder and decoder described above would typically be employed in both mobile phones and in base stations of a cellular telephone network.

Figure 7:
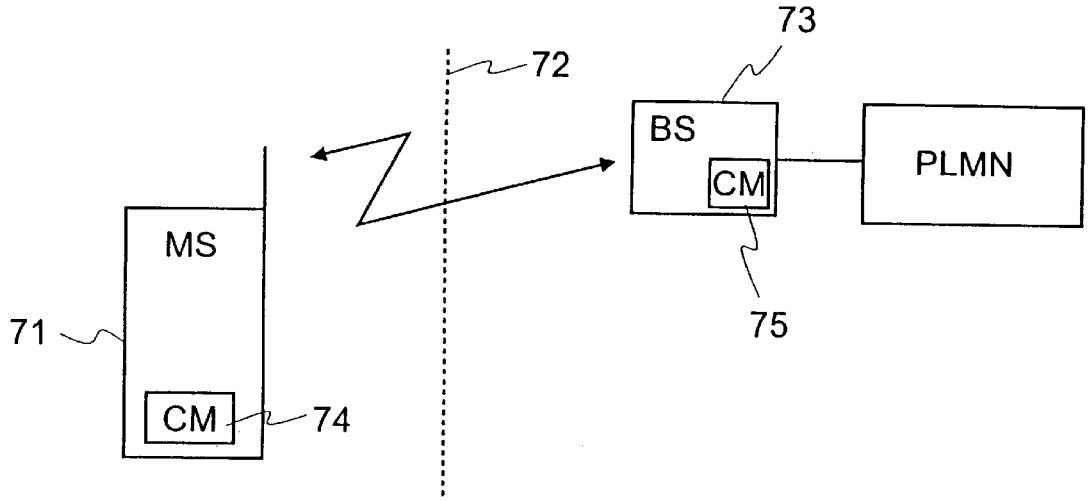
FIG. 7 is a block diagram illustrating further embodiments of the invention.

The block chart of FIG. 7 illustrates some preferred embodiments of the invention. In FIG. 7 there is a mobile station 71 arranged to communicate through an air interface 72 with a base station 73 of a mobile communication network. The information transferred between the mobile station and the base station comprise sampled speech signals, which are encoded and decoded in the transmitting and receiving ends accordingly. The mobile station 71 and the base station 73 according to the invention comprise computer means 74 and 75 for encoding and decoding sampled speech signals according to the method described above. Computer means substantially comprise input means for receiving sampled speech signals, output means for outputting sampled speech signals, and a processor for implementing preprogrammed methods for encoding and decoding sampled speech signals.

The encoders and decoders may also be employed, for example, in multimedia computers connectable to local-area-networks, wide-area-networks, or telephone networks. Encoders and decoders embodying the present invention may be implemented in hardware, software, or a combination of both.

What is claimed is:

1. A method of coding a sampled speech signal, the method comprising dividing the speech signal into sequential frames and, for each current frame:

generating a first set of linear prediction coding (LPC) coefficients which correspond to the coefficients of a linear filter and which are representative of short term redundancy in the current frame;

if the number of LPC coefficients in the first set of the current frame differs from the number in the first set of the preceding frame, then generating a second expanded or contracted set of LPC coefficients from the first set of LPC coefficients generated for the preceding frame, the second set containing a number of LPC coefficients equal to the number of LPC coefficients in said first set of the current frame; and encoding the current frame using the first set of LPC coefficients of the current frame and the second set of LPC coefficients of the preceding frame.

2. A method according to claim 1, wherein at least one set of expanded or contracted LPC coefficients from the first set of LPC coefficients generated for the preceding frame, are generated.

3. A method according to claim 2, wherein a set or sets of expanded or contracted LPC coefficients from the first set of LPC coefficients generated for the preceding frame, corresponding to any available number of LPC parameters, is generated.

4. A method according to claim 1, wherein the step of generating the first set of LPCs comprises deriving the autocorrelation function for each frame and solving the equation:

$$a_{opt} = \underline{\underline{R}}_{XX}^{-1} \cdot R_{XX}$$

where $\underline{a}_{opt}$ are the set of LPCs which minimise the squared error between the current frame x(k) and a frame $\hat{x}(k)$ predicted using these LPCs, and $\underline{\underline{R}}_{XX}$ and $\underline{R}_{XX}$ are the correlation matrix and correlation vector respectively.

5. A method according to claim 4 and comprising the step of obtaining an approximate solution to the matrix equation using a recursive process to approximate the LPC coefficients.

6. A method according to claim 5 and comprising solving the matrix equation using the Levinson-Durbin algorithm in which reflection coefficients are generated as an intermediate product.

7. A method according to claim 6, wherein the second expanded or contracted set of LPC coefficients is generated by either adding zero value reflection coefficients, or removing already calculated reflection coefficients, and using the amended set of reflection coefficients to recompute the LPC coefficients.

8. A method according to claim 1, wherein the step of encoding and quantising comprises transforming the first set of LPC coefficients of the current frame, and the second set of LPC coefficients of the preceding frame, into respective sets of transformed coefficients.

9. A method according to claim 8, wherein said transformed coefficients are line spectral frequency (LSP) coefficients.

10. A method according to claim 8 wherein the step of encoding comprises encoding the first set of LPC coefficients of the current frame relative to the second set of LPC coefficients of the preceding frame to provide an encoded residual signal and wherein the step of encoding and quantising further comprises generating said encoded residual signal by evaluating the differences between said two sets of transformed coefficients.

11. A method according to claim 1, wherein the step of encoding comprises encoding the first set of LPC coefficients of the current frame relative to the second set of LPC coefficients of the preceding frame to provide an encoded residual signal.

12. A method of decoding a sampled speech signal which contains encoded linear prediction coding (LPC) coefficients for each frame of the signal, the method comprising, for each current frame:

decoding the encoded signal to determine the number of LPC coefficients encoded for the current frame;

where the number of LPC coefficients in a set of LPC coefficients obtained for the preceding frame differs from the number of LPC coefficients encoded for the current frame, expanding or contracting said set of LPC coefficients of the preceding frame to provide a second set of LPC coefficients; and combining said second set of LPC coefficients of the preceding frame with LPC coefficient data for the current frame to provide at least one set of LPC coefficients for the current frame.

13. A method according to claim 12, wherein at least one set of expanded or contracted LPC coefficients of the preceding frame are generated.

14. A method according to claim 13, wherein a set or sets of expanded or contracted LPC a coefficient of the preceding frame, corresponding to each available LPC model order, is generated.

15. A method according to claim 12, wherein the encoded signal contains a set of encoded residual signal, the method further comprising decoding the encoded signal to recover the residual signal and combining the residual signal with the second set of LPC coefficients of the preceding frame to provide LPC coefficients for the current frame.

16. A method according to claim 12 and comprising combining the set of LPC coefficients obtained for the current frame, and the second set obtained for the preceding frame, to provide sets of LPC coefficients for subframes of each frame.

17. A method according to claim 16, wherein the sets of coefficients are combined by interpolation or by interpolating LSP coefficients or reflection coefficients.

18. Computer means arranged and programmed to carry out the method of coding a sampled speech signal, wherein the speech signals are divided into sequential frames and, for each current frame:

a first set of linear prediction coding (LPC) coefficients which correspond to the coefficients of a linear filter and which are representative of short term redundancy in the current frame is generated;

if the number of LPC coefficients in the first set of the current frame differs from the number in the first set of the preceding frame, a second expanded or contracted set of LPC coefficients is generated from the first set of LPC coefficients generated for the preceding frame, the second set containing a number of LPC coefficients equal to the number of LPC coefficients in said first set of the current frame; and the current frame is encoded using the first set of LPC coefficients of the current frame and the second set of LPC coefficients of the preceding frame.

19. A base station of a cellular telephone network comprising computer means (65) according to claim 18.

20. A mobile telephone comprising computer means (64) according to claim 18.

21. Computer means arranged and programmed to carry out the method of decoding a sampled speech signal which contains encoded linear prediction coding (LPC) coefficients for each frame of the signal, wherein for each current frame:

the encoded signal is decoded to determine the number of LPC coefficients encoded for the current frame;

where the number of LPC coefficients in a set of LPC coefficients obtained for the preceding frame differs from the number of LPC coefficients encoded for the current frame, said set of LPC coefficients of the preceding frame is expanded or contracted to provide a second set of LPC coefficients; and said second set of LPC coefficients of the preceding frame is combined with LPC coefficient data for the current frame to provide at least one set of LPC coefficients for the current frame.

* * * * *